US006481885B2

(12) United States Patent
Dupre

(10) Patent No.: US 6,481,885 B2
(45) Date of Patent: Nov. 19, 2002

(54) HYDRODYNAMIC STIRRING DEVICE AND LANCE

(75) Inventor: Alain Dupre, Le François (FR)

(73) Assignee: Petrojet International (FR)

( * ) Notice: Subject to any disclaimer, the term of this patent is extended or adjusted under 35 U.S.C. 154(b) by 0 days.

(21) Appl. No.: 09/832,428

(22) Filed: Apr. 11, 2001

(65) Prior Publication Data

US 2001/0038572 A1 Nov. 8, 2001

Related U.S. Application Data

(63) Continuation of application No. PCT/FR99/00985, filed on Apr. 26, 1999.

(30) Foreign Application Priority Data

Oct. 12, 1998 (MX) ..... 0988438

(51) Int. Cl.[7] ..... B01F 5/20

(52) U.S. Cl. ..... 366/137; 366/167.2; 366/173.2; 239/261

(58) Field of Search ..... 366/136, 137, 366/159.1, 167.1, 167.2, 168.2, 173.1, 173.2; 137/563; 208/13; 210/194, 197, 805; 134/166 R, 167 R, 168 R, 169 R; 415/80; 416/20 R, 90 R, 92; 239/251, 261

(56) References Cited

U.S. PATENT DOCUMENTS

| | | | | |
|---|---|---|---|---|
| 1,073,878 | A | * | 9/1913 | Trent |
| 1,135,080 | A | * | 4/1915 | Vandercook |
| 1,156,946 | A | * | 10/1915 | Vandercook |
| 1,192,478 | A | * | 7/1916 | Vandercook |
| 1,240,904 | A | * | 9/1917 | Trent |
| 1,978,015 | A | * | 10/1934 | Erdman |
| 2,559,518 | A | * | 7/1951 | Smith |
| 2,592,904 | A | * | 4/1952 | Jackson |
| 2,661,241 | A | * | 12/1953 | Veneziano |
| 2,983,452 | A | * | 5/1961 | Lindbloom |
| 3,136,828 | A | * | 6/1964 | Rideout |
| 3,402,725 | A | * | 9/1968 | Booth |
| 3,409,030 | A | * | 11/1968 | Schmidt |
| 3,586,294 | A | * | 6/1971 | Strong |

(List continued on next page.)

FOREIGN PATENT DOCUMENTS

| | | | |
|---|---|---|---|
| DE | 32 10 339 A1 | | 10/1983 |
| EP | 0 160 805 A2 | | 11/1985 |
| GB | 1517509 | * | 7/1978 |
| SU | 626800 | * | 8/1978 |

*Primary Examiner*—Charles E. Cooley
(74) *Attorney, Agent, or Firm*—Schnader Harrison Segal & Lewis LLP

(57) ABSTRACT

A hydrodynamic stirring device which dissolves, mixes or puts back into suspension or into a "sol" in a primary liquid phase, a deposited sediment which is contained in a tank and covered by the primary liquid phase. The stirring device includes a suction device, including at least one pumps to remove liquid from the primary liquid phase in the tank, and an injector connected to a discharge side of the suction device. The injector is equipped for reinjecting the liquid into the tank, towards the deposited sediment, in the form of at least one jet having a predefined pressure and flow rate. The injector further includes at least one tube which bears at an end portion thereof, a self-rotating lance. The lance a hollow cylindrical stator which is open at both of its end portions. At a first of its end portions to the injector tube. At a second of its end portions, the stator is connected to a nozzle bearing rotor which is rotatably mounted on the stator. At least two nozzles or jets are borne at the periphery of the stator. At least one of the nozzles or jets has an orifice directed to have a tangential component with respect to the nozzle bearing rotor, wherein the nozzles are arranged such that the resultant forces of the radial components is canceled out.

21 Claims, 12 Drawing Sheets

U.S. PATENT DOCUMENTS 3,675,850 A * 7/1972 Ebert
3,809,317 A * 5/1974 Bender
3,871,272 A * 3/1975 Melandri
3,874,399 A * 4/1975 Ishihara
4,179,220 A * 12/1979 Rippon
4,249,828 A * 2/1981 Condolios
4,332,484 A * 6/1982 Peters
4,367,048 A * 1/1983 Morita
4,426,233 A * 1/1984 Manabe et al.
4,582,255 A * 4/1986 Won
4,716,917 A * 1/1988 Schmidt
4,838,703 A * 6/1989 McMaster et al.
5,061,080 A * 10/1991 MacKay et al.
5,078,799 A * 1/1992 Matter et al.
5,087,294 A 2/1992 Rechtzigel
5,301,702 A * 4/1994 McKinney
5,445,173 A * 8/1995 Aiken
5,558,434 A * 9/1996 Hamada et al.
5,620,250 A * 4/1997 Chilcoat et al.
5,658,076 A * 8/1997 Crump et al.
5,810,473 A * 9/1998 Manabe et al.
5,863,119 A * 1/1999 Yergovich et al.
5,897,767 A * 4/1999 Patel
5,899,560 A * 5/1999 Byers
6,109,778 A * 8/2000 Wilmer
6,217,207 B1 * 4/2001 Streich et al.

* cited by examiner

Fig. 9
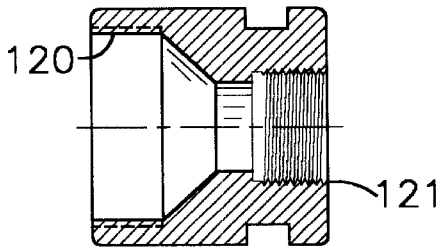
Fig. 10
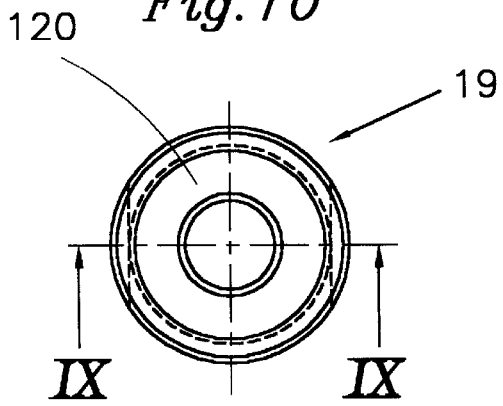
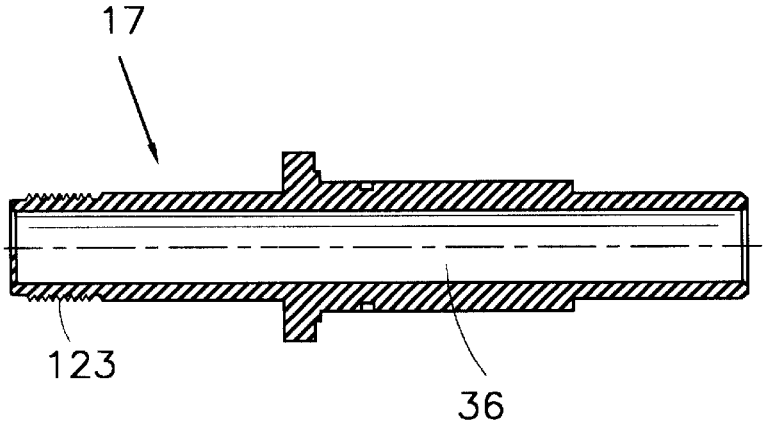
Fig. 11
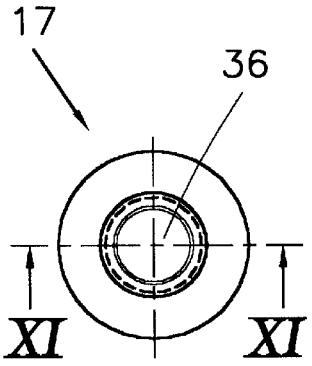
Fig. 12

Fig. 13
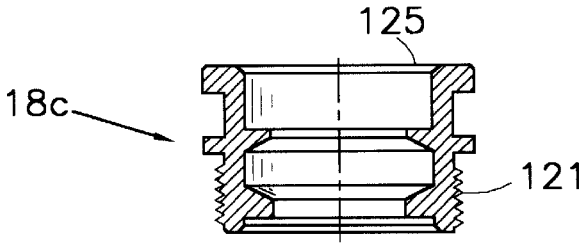
Fig. 14
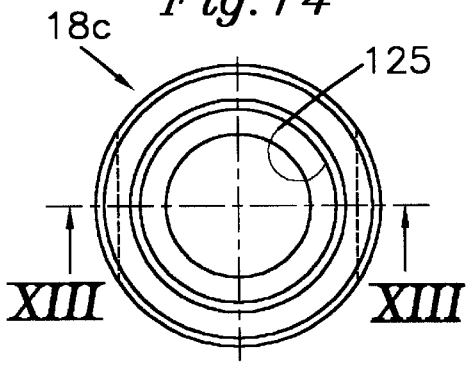
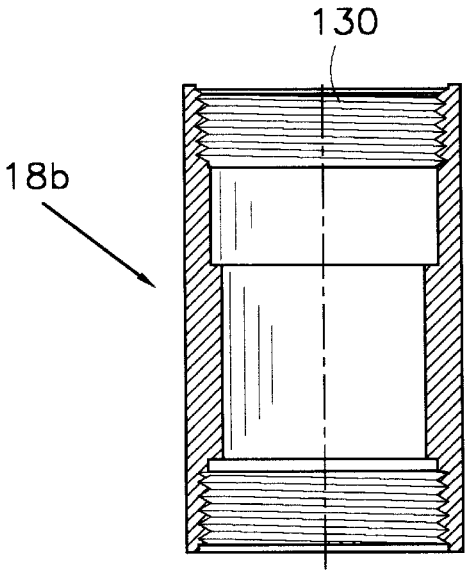
Fig. 15
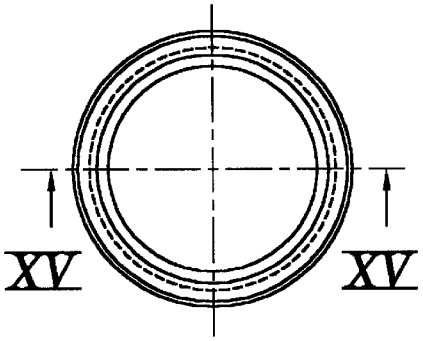
Fig. 16

HYDRODYNAMIC STIRRING DEVICE AND LANCE

RELATED APPLICATION

This is a continuation of International Application No. PCT/FR99/00985, with an international filing date of Apr. 26, 1999, which is based on Mexican Patent Application No. 988438, filed Oct. 12, 1998.

FIELD OF THE INVENTION

This invention relates to a hydrodynamic stirring device to dissolve, mix or put back into suspension or into a "sol", in a primary liquid phase, a sediment which is contained in a tank and covered by said primary liquid phase.

BACKGROUND

Equipment for cleaning oil tanks including rotary lances having fluid ejection nozzles is known from the state of the art patent U.S. Pat. No. 5,087,294. These nozzles are radially orientated and require that the nozzle carrier be driven by a motor.

A hydrodynamic stirrer, disclosed by patent EP 0 160 805, is also known in the state of the art, wherein the device comprises, in one of the alternative embodiments, a self-rotating lance fitted with nozzles directed orthogonally with respect to the axis of rotation of the rotor, so as to project horizontal jets. An additional nozzle is directed at about 45° with respect to the axis of rotation, to form a jet of liquid angled downwards.

The disadvantage of the device of the prior art is that the tubes, at the bottom ends of which the self-rotating lances are connected, have a tendency to fracture in the region of their upper end, where they are attached to the roof of the tank. This fracturing is apparently due to the fact that the tubes which may have a length of from 15 to 20 meters, are subject to bending forces, the direction of which varies at every instant as a function of the angular position of the rotor of the lance. The result is fatigue in the lance that may bring about the fracture or at least cracking of the lance or the tube which is supporting it, which then causes a major malfunction of the device.

SUMMARY OF THE INVENTION

This invention provides a remedy to these drawbacks by providing a self-rotating hydrodynamic stirring device that is robust and reliable. To this end, the invention in its most general form relates to a device fitted with nozzle bearing lances, having nozzles arranged in such a way that the resultant of the radial components is canceled out.

In accordance with one preferred embodiment, the nozzles are arranged in angular directions and with orientations such that the axes of their respective orifices are deduced from one another by rotation through an angle of 360°/n about the central axis of the nozzle bearing rotor, wherein n is the number of nozzles located on the periphery of the nozzle bearing rotor.

According to one particular alternative, each of the nozzles located at the periphery of the nozzle bearing rotor has an orifice, the axis of which forms an angle of about 30° with respect to the radius corresponding to the angular position in which the nozzle under consideration is to be found.

According to one preferred embodiment, the axes of the orifices of the nozzles are offset laterally with respect to radial longitudinal planes. Under the term "radial plane", a plane is understood, defined by the longitudinal axis of the nozzle carrier on the one hand, and by a radial axis perpendicular to the longitudinal axis, the radial axis being parallel to the median axis of the orifice of the nozzle. The median axis of the orifice of a nozzle is not in a radial plane, but in a plane parallel to a radial plane.

Advantageously, the device comprises two nozzles, the orifice axes of which are parallel and laterally offset on either side of a median plane formed by a diametrical axis and the longitudinal axis. The lateral offset between the axis of the orifice of the nozzle carrier and the plane formed by a radial axis and the longitudinal axis is preferably between about 8 and about 14 mm, and preferably about 9 mm.

According to one particular embodiment, the device comprises three nozzles each having an orifice with a diameter of about 5 mm, the third nozzle having its axis merged with the axis of rotation of the nozzle bearing rotor.

BRIEF DESCRIPTION OF THE DRAWINGS

The invention will be better understood on reading the description which follows, and referring to the appended drawings that correspond to non-limiting exemplary embodiments wherein:

FIG. 9 represents a view of the main connector in longitudinal section, taken along line IX—IX of FIG. 10;

FIG. 10 represents a view of the main connector in transverse section;

FIGS. 11 represents a view of the stator in longitudinal section, taken along line XI—XI of FIG. 12;

FIG. 12 represents a view of the stator in transverse section;

FIGS. 13 represents a view of the rotor connector in longitudinal section, taken along line XIII—XIII of FIG. 14;

FIG. 14 represents a view of the rotor connector in transverse section;

FIGS. 15 represents a view of the first rotor body in longitudinal section, taken along line XV—XV of FIG. 16;

FIG. 16 represents a view of the first rotor body in transverse section;

DETAILED DESCRIPTION

Figure 1:
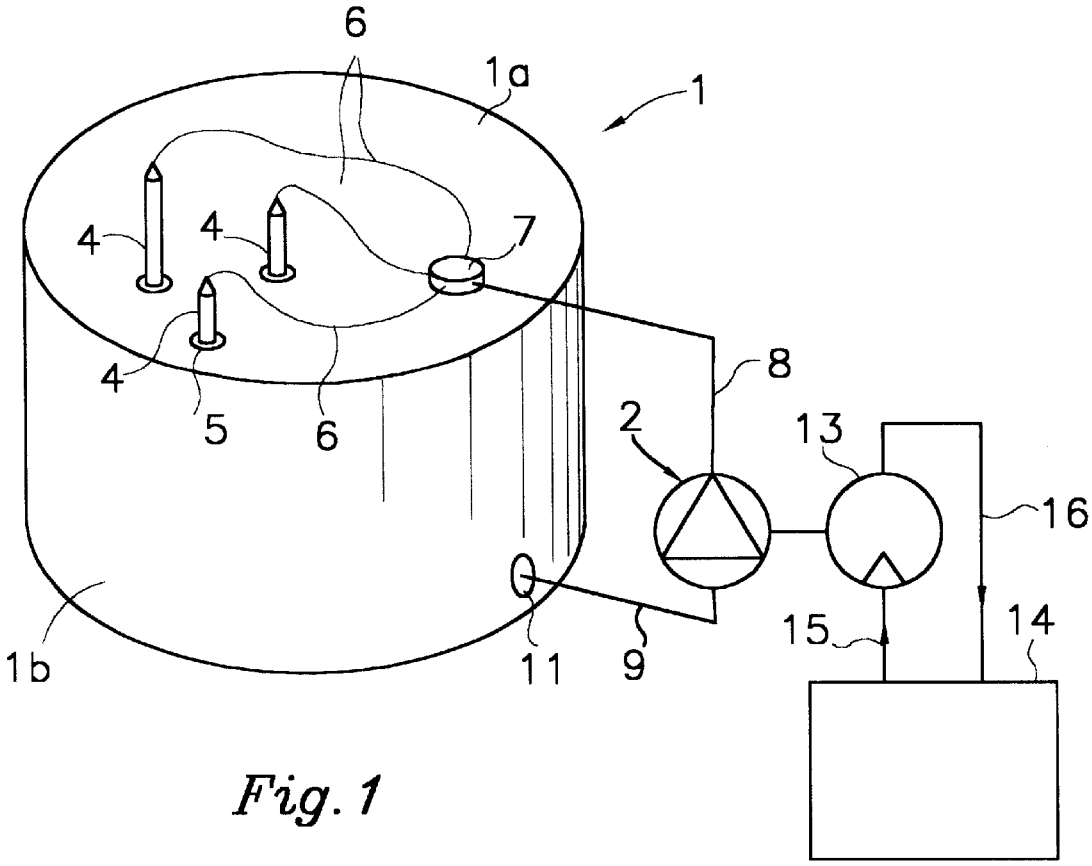
FIG. 1 represents a diagrammatic view of a tank fitted with a device according to the invention.

FIG. 1 depicts a tank (1) of cylindrical shape, equipped with a roof (1*a*) rigidly fixed to the side wall (1*b*) of the tank (1). The tank may also have a roof that floats on the liquid product contained in the tank (1). In this case, sealing elements are provided at the periphery of the roof (1*a*). The tank (1), particularly when it is intended for the storage of crude oil, may have a diameter of several tens or indeed a hundred meters and a height of 15 meters or more. The crude oil progressively settles and gives rise to a sediment which is deposited on the bottom (1*c*) (FIG. 2) of the tank (1) in the form of a layer that may be up to several meters thick and which has a relatively uneven top surface.

Figure 2:
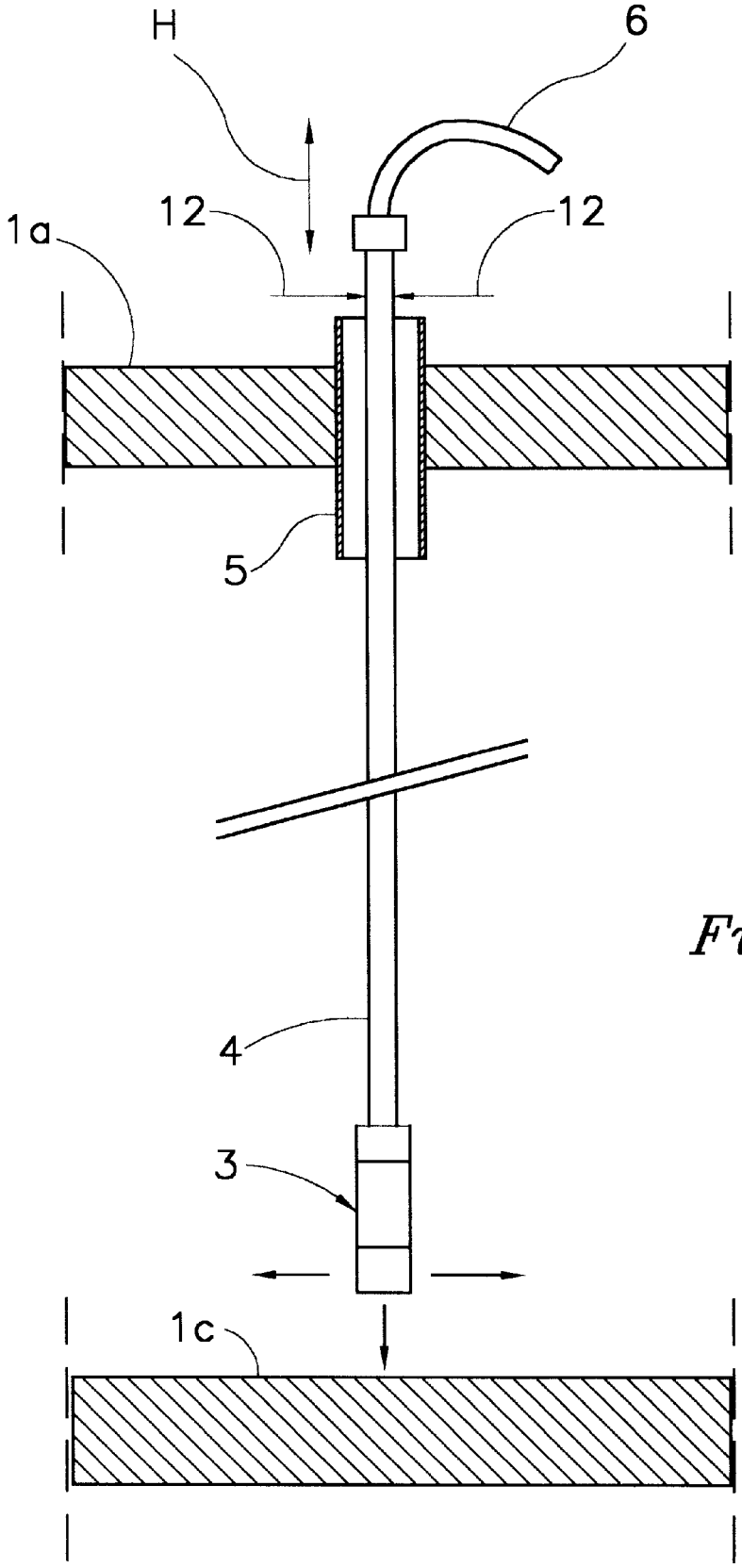
FIG. 2 is a partial sectional view of the tank shown in FIG. 1, showing a tube with its lance submerged in said tank.

Cleaning of the tank is carried out by drawing off the liquid contained in the tank (1) using at least one pump (2) and reinjecting the liquid pumped in this way, at a flow rate and at a predetermined pressure, against the sediment layer using a lance (3) as shown in FIG. 2, and preferably several self-rotating lances (3) to break up the sediments and put them back into suspension in the liquid phase. When virtually all of the sediments forming the layer have been dissolved or put back into suspension in the liquid phase, the latter may be discharged from the tank (1) in a known way.

As shown in FIG. 2, each lance (3) may be fixed to the lower end of a tube (4) which passes through a sheath (5) provided on the roof (1*a*) of the tank (1), the top end of the tube being connected to a flexible hose (6) connected to a flow distributor (7). This flow distributor (7) is connected to a pipeline (8) to the discharge side of the pump (2), the inlet side of which is connected, through another pipeline (9) to a liquid intake (11) located, for example, in the lower part of the side wall (1*b*) of the tank (1). Each tube (4) may be held in the desired height position using a locking device shown diagrammatically by the two arrows 12 in FIG. 2 and which is supported by each sheath (5) or by the roof (1*a*) of the tank (1).

The sheaths (5) through which the tubes (4) pass are evenly distributed over the surface of the roof (1*a*) of the tank (1). The lances are preferably distributed in several groups, for example, of three lances, as shown in FIG. 1, and each group of lances is supplied with liquid by its own pump (2). By subdividing the lances into several groups, the advantage is that the pipes or other pipelines (8, 9) to be handled are lighter. The speed of assembly is improved and the modularity of the stirring device is increased. Preferably, each pump (2) is a volumetric pump with positive displacement, powered by its own motor (13), or by a single motor, comprising a hydraulic motor connected to a hydraulic pressure generator (14) by pipelines (15 and 16). If the tank (1) is a storage tank for crude oil or any other inflammable refinery product which releases inflammable vapors, the tank (1) or a group of tanks of this kind is surrounded by a tank dike. In this case, the hydraulic pressure generator (14) is located outside the tank dike, in such a way that there is no electrical equipment that might generate sparks within the explosion risk area.

Figure 3:
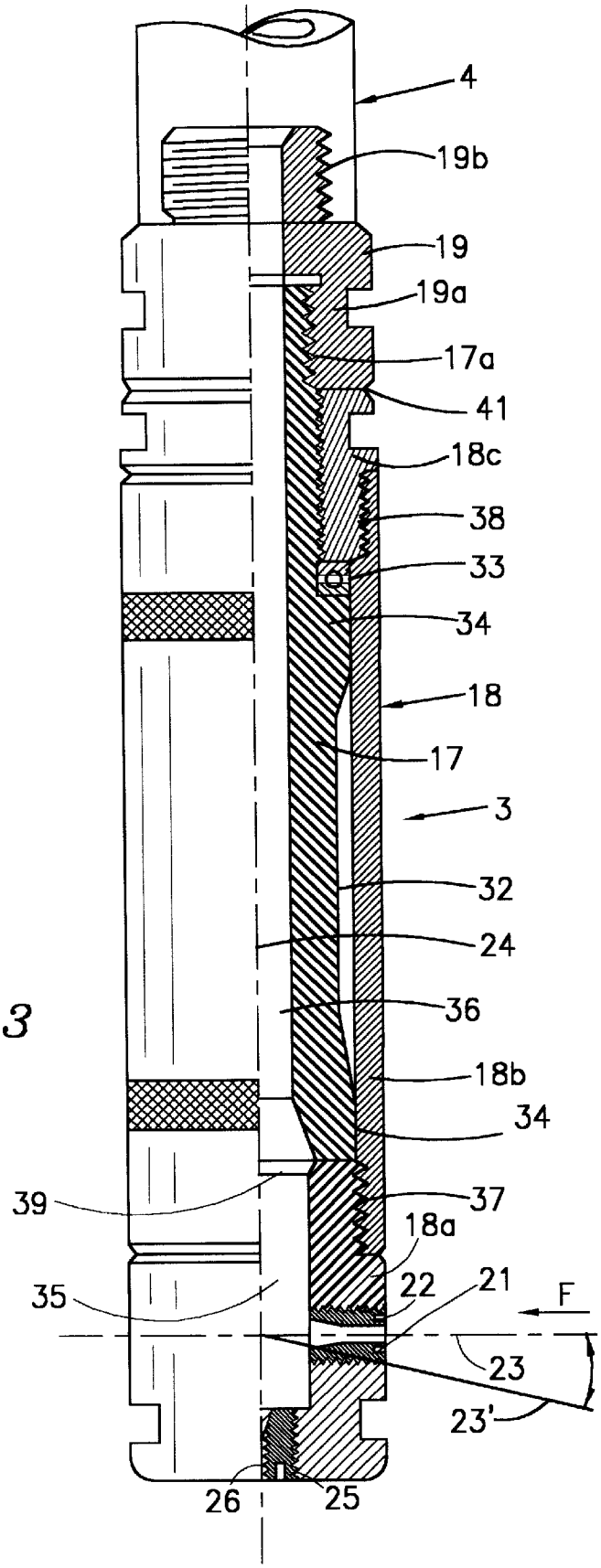
FIG. 3 represents a partial elevation view and vertical sectional view of a lance according to the invention.

Each lance (3) is a self-rotating lance creating a flow rate of about 10 cubic meters per hour. As shown in FIG. 3, it comprises a hollow cylindrical stator (17) and a nozzle bearing rotor (18) rotatably mounted on the stator (17).

The hollow cylindrical stator (17) is open at both ends. It is fitted at its upper end with an external thread (17*a*) by means of which it is connected to one of the tubes (4) by means of a connector (19) fitted with a complementary internal thread (19*a*). The connector (19) is also fitted with an external thread (19*b*) that enables it to be screwed into the internal thread of the tube (4). The connector (19) may be a sleeve, internally threaded at both ends in the case where the tube (4) is fitted with an external thread.

Figure 4:
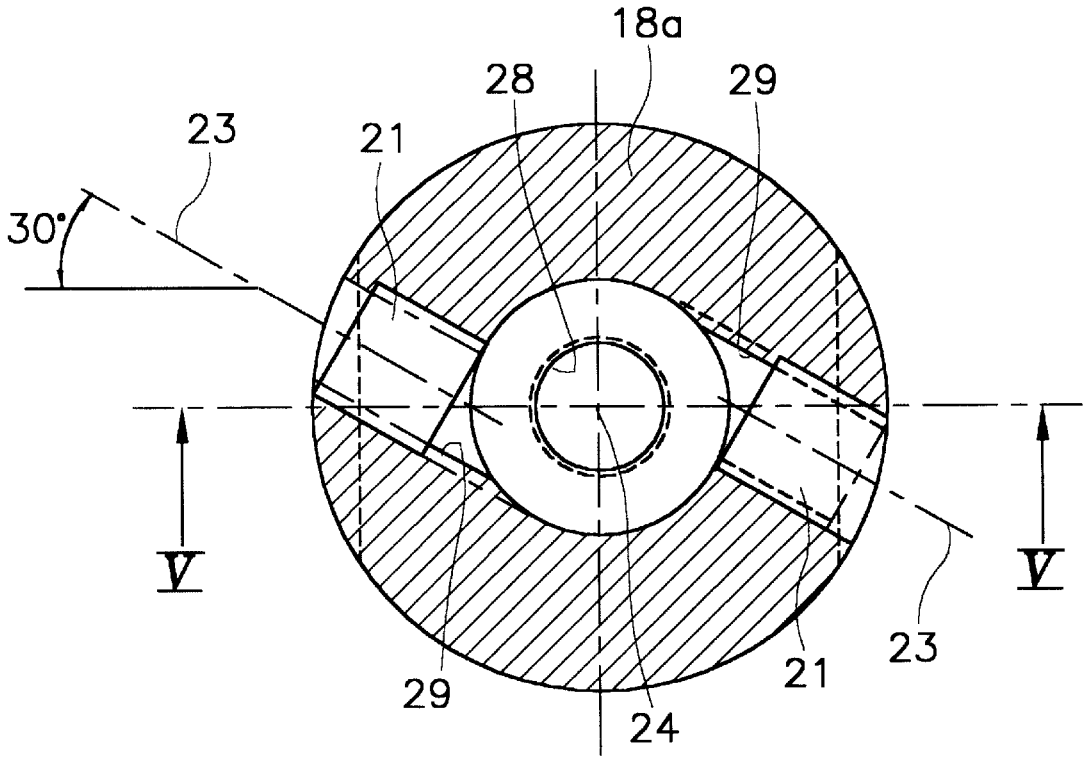
FIGS. 4 represents a sectional view, on a larger scale, of the lower element of the rotor of the lance shown in FIG. 3.
Figure 5:
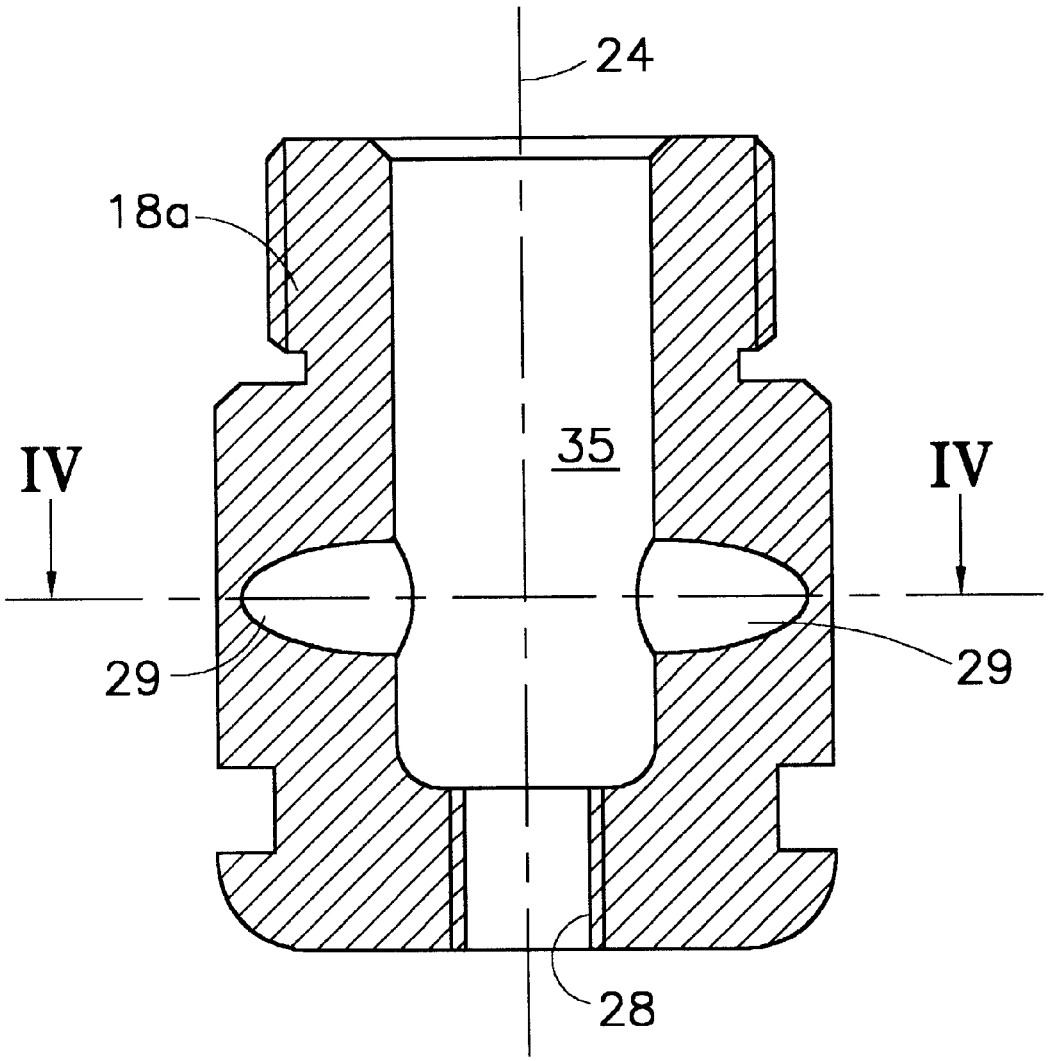
FIG. 5 represents a sectional view taken along line V—V of FIG. 4.

At its lower end, the hollow cylindrical stator (17), communicates with the inside of the nozzle bearing rotor (18) which is hollow and which supports, on its periphery, several nozzles or jets (21) as shown in FIG. 4. The nozzles (21) are wearing components. Preferably they are produced in the form of components that may be detached from the nozzle bearing rotor (18) so that quick replacement is possible. Each nozzle (21) has an orifice with a diameter of about 5 mm, the axis (23) of which is oriented along a direction having a tangential component with respect to the nozzle bearing rotor (18). The axes (23) of the nozzles (21) are deduced from one another by rotation through an angle of 180° in the case of two nozzles. In the example shown in FIG. 4, the axis (23) of the orifice (22) of each nozzle (21) makes an angle of about 30° with respect to the corresponding radius at the angular position in which the nozzle being considered is found. The axes (23) of the orifices (22) of the nozzles (21) are located in one and the same plane P perpendicular to the axis of rotation (24) of the nozzle carrier (18).

The axes of the orifices (21) might also be inclined in the direction of the axis of rotation (24) of the nozzle bearing rotor (18), towards the lower end. In this case, each axis forms an angle of the order of 75° with respect to the axis (24), or an angle of about 15° with respect to plane P.

Figure 6:
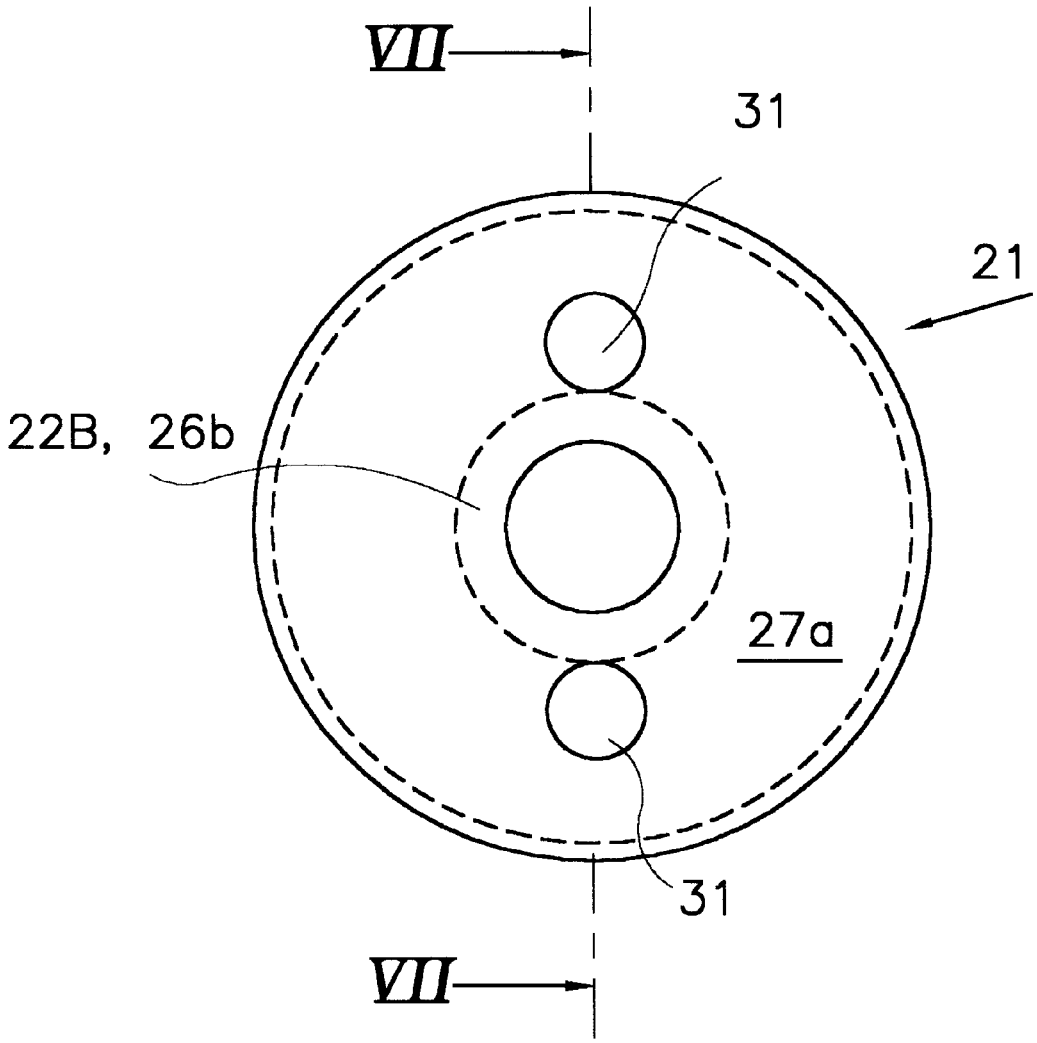
FIG. 6 represents on an even greater scale a jet nozzle of the rotor in FIG. 3.

Preferably, the nozzle bearing rotor (18) carries an extra nozzle (25) as shown in FIG. 6. This nozzle (25) is produced in an identical manner to that for the other nozzles (21), and has an orifice (26) the axis of which merges with the axis of rotation (24) of the nozzle bearing rotor (18).

Figure 7:
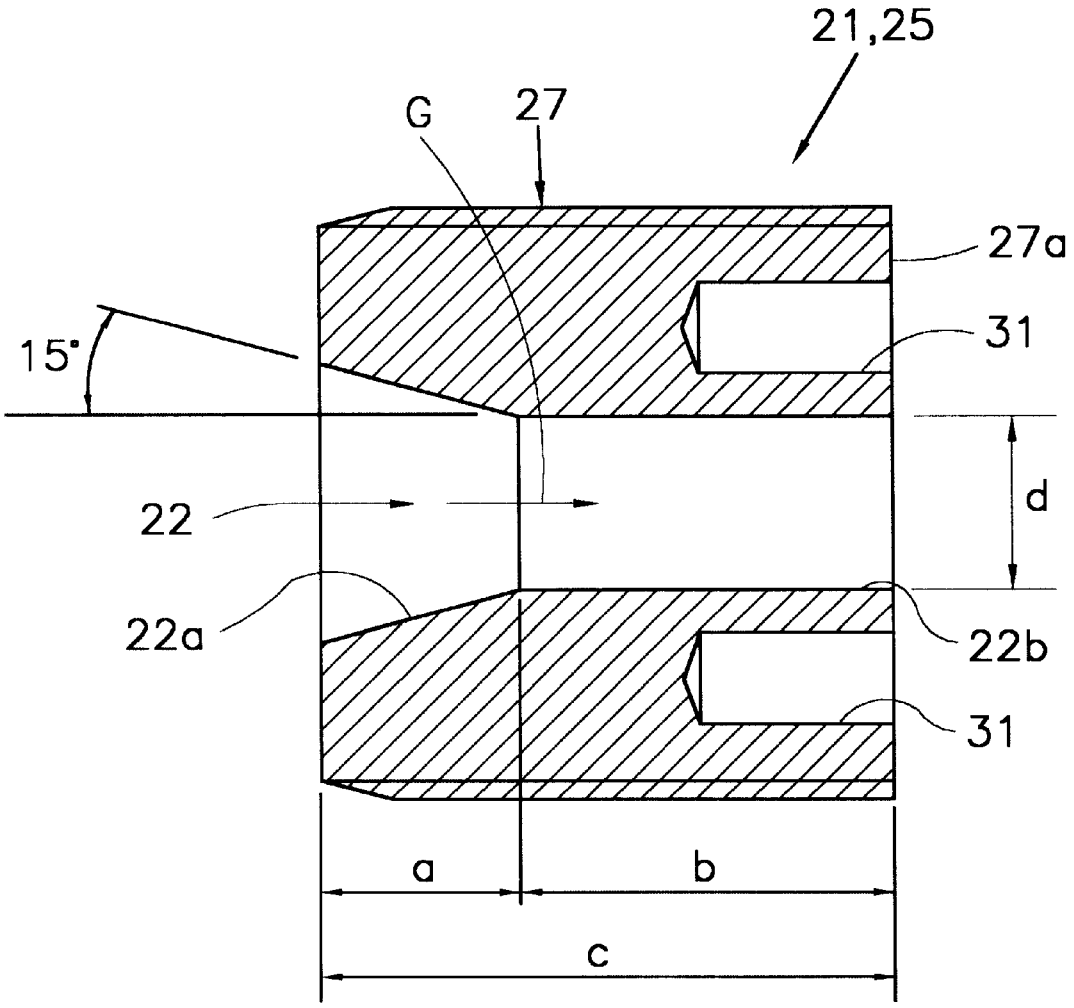
FIG. 7 represents a view along a section VII—VII in FIG. 6.

As shown in FIGS. 6 and 7, the nozzle (25) or each of the nozzles (21) has the shape of a cylindrical body (27) externally threaded so that it may be screwed into a tapped hole (28 or 29) in the nozzle bearing rotor (18). Preferably, the cylindrical body (27) has an axial length that approximately corresponds to the thickness of the wall of the nozzle bearing rotor, so that, after having been screwed into the tapped hole (28), its front face (27*a*) is substantially flush with the external peripheral surface of the nozzle bearing rotor and does not project from it. In this way, the nozzles (21) do not risk being damaged when the lance (3) is engaged in the tank (1) through one of the sheaths (5). Two blind holes (31) are made in the front face (27*a*) of the body (27) in order to allow screwing of the nozzle (21 or 25) into the corresponding hole (28 or 29) by using a suitable wrench.

As better seen in FIG. 7, the orifice (22 or 26) of each nozzle (21 or 25) comprises a first conical part (22*a*, 26*a*) that tapers in the direction of the flow of the liquid indicated by arrow G, and a second cylindrical part (22*b*, 26*b*). Preferably, the conical part (22*a*, 26*a*) has an axial length a which is about equal to double the axial length b of the cylindrical part (22*b*, 26*b*). The inlet region of the conical part (22*a*, 26*a*) and the transition zone between this conical part and the cylindrical part (22*b*, 26*b*) may be rounded off so as to reduce the loss coefficient and to improve the performance of the nozzles. Such nozzles produce a jet, the shape of which creates a region of low pressure around the jet. This region of low pressure induces a strong secondary current that flows down the length of the lance and promotes the setting into motion of the whole volume of liquid.

In the case of a device intended for a crude oil storage tank, the conical part (22*a*) of the orifice (22) of each nozzle (21, 25) may have a cone apical angle of about 30°, and the cylindrical part (22*b*) may have a diameter of about 5 mm.

It may be seen in FIG. 3 that the nozzle bearing rotor (18) surrounds the hollow cylindrical stator (17) over the major part of its length, and that an elongate annular chamber (32) is formed between the rotor and the stator. This chamber (32) is practically closed off at its two ends and it contains a thrust ball bearing or thrust needle bearing (33) and at least one radial bearing, preferably two radial bearings (34) for mounting the nozzle bearing rotor (18) so that it may rotate with respect to the stator (17).

For reasons of simplicity of manufacture and of assembly, the nozzle bearing rotor (18) may comprise three parts (18*a*, 18*b* and 18*c*) arranged successively in the axial direction as shown in FIG. 3. The part (18*a*) extends the hollow cylindrical stator (17) to the lower end of it and has a cavity (35) which is in communication with the internal channel (36) of the hollow cylindrical stator (17).

The nozzles (21, 25) are preferably carried on this part, the nozzle carrier (18*a*) of the rotor (18). The intermediate part (18*b*) of the nozzle bearing rotor is in the form of a cylindrical tubular element which surrounds the cylindrical stator (17) and which has a greater internal diameter than the external diameter of the cylindrical stator (17), in such a way that an extended annular chamber (32) is formed. The part (18*c*) of the nozzle bearing rotor surrounds the cylindrical stator (17) with a small radial clearance and closes off the chamber (32) at its upper end, on the side of the connector (19) and the tube (4).

Each of the two radial bearings (34) may be a plain upper bearing. To this end, the cylindrical stator (17) has, on its external surface, inside the chamber (32), two cylindrical parts, axially spaced apart, which have a greater external diameter than the remaining part of said stator (17) and which form the two bearings (34) mentioned above. The axial thrust ball bearing (33) is arranged between the part (18*c*) of the nozzle bearing rotor (18) and that of the two cylindrical parts of greater diameter of said stator (17), which form the upper plain bearing (34). At least both parts (18*b*, 18*c*) of the rotor are produced in the form of separate elements fitted with complementary cylindrical threaded parts (37, 38) that enables them to be assembled.

The stator (17) and the three parts (18*a* to 18*c*) are dimensioned in such a way that a radial annular slit (39) of small width is formed between the lower end of the stator (17) and the upper end of the part (18*a*) of the rotor. In this way a leakage path is created for the liquid supplied through the pipe (4) into the lance (3). This path starts from the channel (36) and the cavity (35) and extends successively through the radial annular slit (39), the annular clearance in the lower plain bearing (34), the chamber (32), the annular clearance in the upper plain bearing (34), the axial thrust ball bearing (33), the annular clearance between the part (18*c*) and the stator (17) and finally the radial annular slit (41) formed between the part (18*c*) and the connector (19). The liquid which leaks along this path provides lubrication of the two plain bearings (34) and the thrust ball bearing (33). It prevents solid particles or impurities located outside the lance (3) from being able to reach by counterflow the inside of chamber (32), which thereby contributes to preventing the clogging up of the thrust ball bearing (33) and plain bearings (34).

Figure 8:
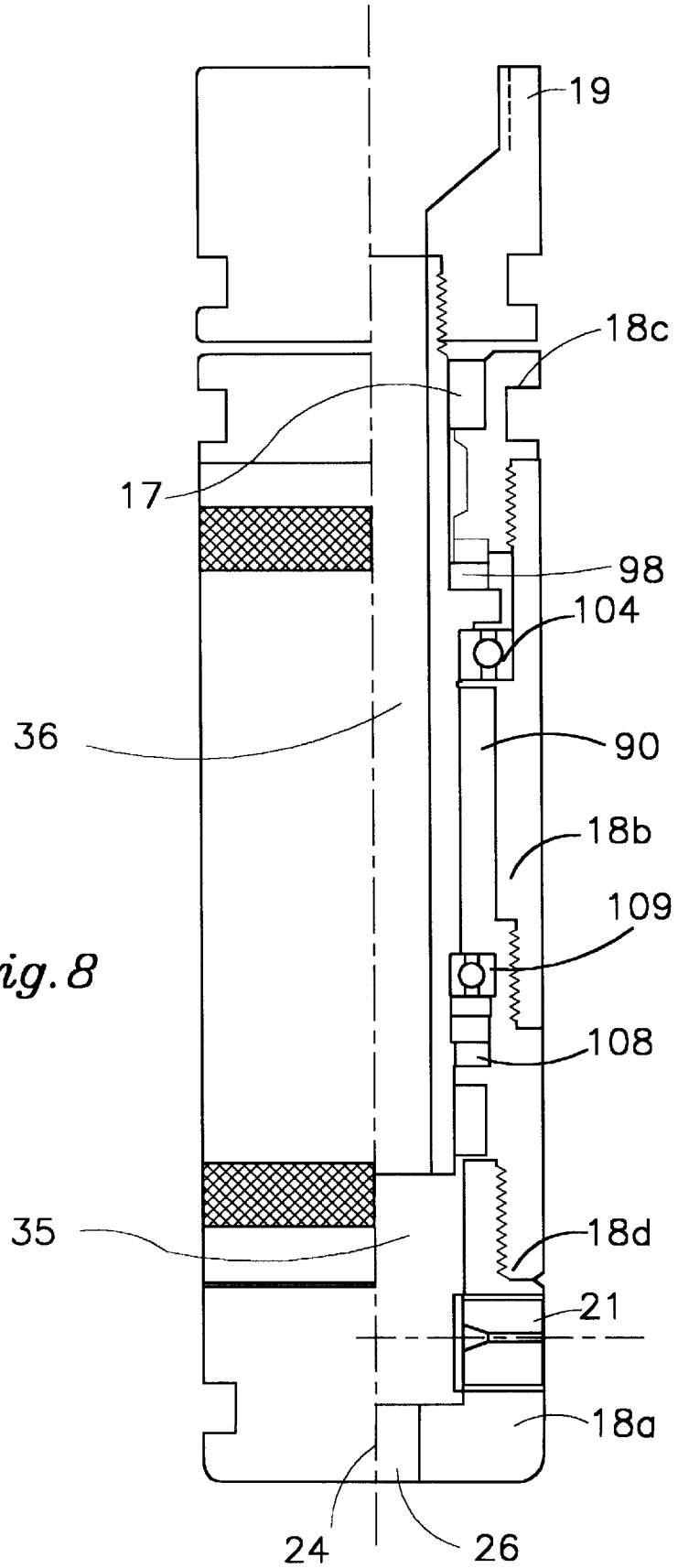
FIG. 8 represents a sectional view of a lance according to a preferred alternative embodiment.
Figure 17:
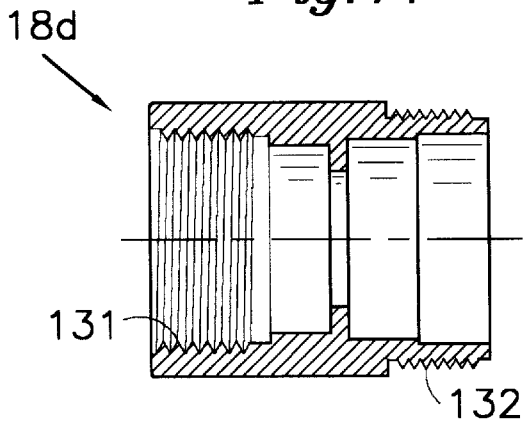
FIGS. 17 represents a view of the second rotor body in longitudinal section, taken along line XVII—XVII of FIG. 18.
Figure 18:
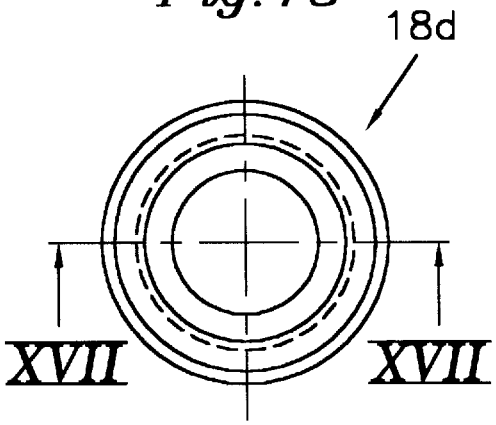
FIG. 18 represents a view of the second rotor body in transverse.

FIG. 8 and the subsequent figures relate to an alternative of the preferred embodiment.

In this embodiment, the rotor includes four subparts, 18*a*–18*d*, where 18*a* is the nozzle carrier.

FIG. 8 represents a partial sectional view of a lance. The lance is represented in this FIG. in a vertical position, corresponding to its position in use. It has a nozzle carrier (18*a*) bearing an axial nozzle (25) coaxial with the longitudinal axis (24) of the lance and the nozzle carrier (18*a*). This axial nozzle (25) is directed towards the bottom of the tank when the lance is in operation. The nozzle carrier (18*a*) additionally comprises two lateral nozzles (21) located on its periphery. The number of lateral nozzles may be other than two, and the axial nozzle (25) is optional.

The axial nozzle (25) produces a vertical jet which contributes to the breaking up of the sediments, particularly when the lance is lowered sufficiently so that the lower front face is close to the sediment. In this way, the axial nozzle (25) facilitates the dissolution and the production of a "sol" from the sediments.

The peripheral nozzles (21) are arranged at regular and equal intervals on the periphery of the nozzle carrier (18*a*). The function of this distribution is to balance the forces of reaction produced by the jets of liquid projected by the lateral nozzles (21) which act to turn the rotor about its axis (24) in a balanced way, without any lateral bending forces on the tube to which the lance is connected.

The direction of the jets leaving the lateral nozzles (21) is selected in such a way that the rotor assembly turns in a direction that has a tendency to screw the different components of the lance into one another, in such a way that there is no fear, during operation, of unscrewing the lance with respect to the tube which supplies it with the liquid or of unscrewing the various components from one another.

The axes of the lateral nozzles (21) may form a plane orthogonal to the axis of rotation of the rotor, and the nozzles then project horizontaljets. It is also possible to incline the nozzles with respect to a transverse plane, for example downwards. By way of example, the angle of inclination may be 75° downwards as shown by line 23' in FIG. 3.

The axes of the peripheral nozzles, whatever their angle of inclination, are each located in a vertical plane parallel to the general axis of rotation (24) of the lance. All these planes are located at an equal orthogonal distance from the axis of rotation (24) in a way that creates a torque or a balanced moment of rotation. The distance is selected in operation, so as to reach the desired speed of rotation. By way of example, a distance of the order of 9 to 10 mm appears to be an optimum distance for a particular application, for a lance of external diameter 72 mm.

The nozzle jets (21) also fulfil the function of agitating, mixing and homogenizing the liquid phases which are present possibly with particles of sediment detached from the bottom. The rotation of the rotor assembly and consequently thejets enables them to act on the entire volume of liquid located around the lance beyond the limit of the radius of direct action of the jets. This direct action is relayed by the currents induced by the jets.

The rotating-assembly formed by the -rotor connector, the rotor and the nozzle carrier will be called "the rotor". The rotor turns around the stator (17) formed by the fixed assembly comprising the main connector (19) and the stator (17).

Two axial rolling bearings (98, 108) and two radial rolling bearings (104, 109) allow rotation and guidance of the rotor assembly and prevent any axial displacement of the rotor assembly upwards or downwards relative to the stator assembly (17). The bearings are made up of ball bearings, needle bearings or roller bearings.

The volume between the rotor (18) and the stator (17) forms a chamber hermetically closed by two rotary joints (91, 111) to prevent the entry of impurities into said chamber (32). This volume additionally comprises a lubrication chamber, since it is filled with a suitable oil to ensure permanent lubrication of the bearings which are immersed in it. This arrangement provides operation of the self-rotating lance in all positions and for a very long period of time without any maintenance operations. It also provides use of non-sealed bearings, with lower friction coefficients than those of pre-lubricated sealed bearings, and which therefore promote better operation of the self-rotating lance. Such an arrangement provides a reduction in kinetic energy losses from the jets that are providing the rotation, while ensuring a longer lifetime for the lance. The joints are manufactured in a chemically inert material that enables the lance to be used in all types of industry, and particularly in the oil or food industry.

FIGS. 9 and 10 represent sectional views of the main connector, with a female connection (120) for its connection to a tube supplying the liquid to be injected. It is connected to the stator (17) by the threaded connection (121).

FIGS. 11 and 12 represent sectional views of the stator. The stator has a threaded part (123) and carries the liquid to be injected to the nozzle carrier (18*a*).

FIGS. 13 and 14 represent a sectional view of the rotor connector (18*c*) fitted with a threaded part (121) for connection to the rotor body (18*b*). The housing (125) receives the upper rotary joint.

FIGS. 15–18 represent sectional views of bodies (18*b*) and (18*d*) of the rotor. The rotor is divided into two parts assembled by screwing them together. The threaded part (130) connects the rotor body (18*b*) to the rotor body (18*d*) through the latter's threaded part (131). The threaded part (132) connects the rotor body (18*d*) to the nozzle carrier (22) through the latter's threaded part (133).

Figure 19:
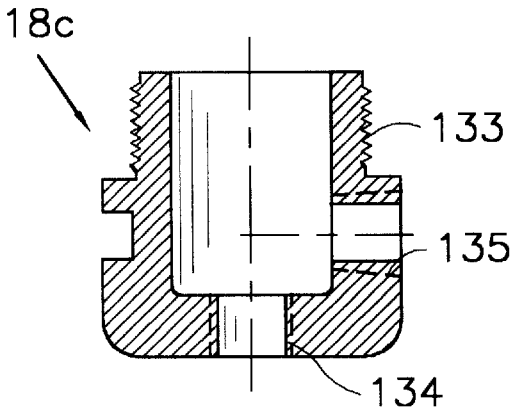
FIGS. 19 represents a view of a nozzle in longitudinal section, taken along line XIX—XIX in FIG. 20.
Figure 20:
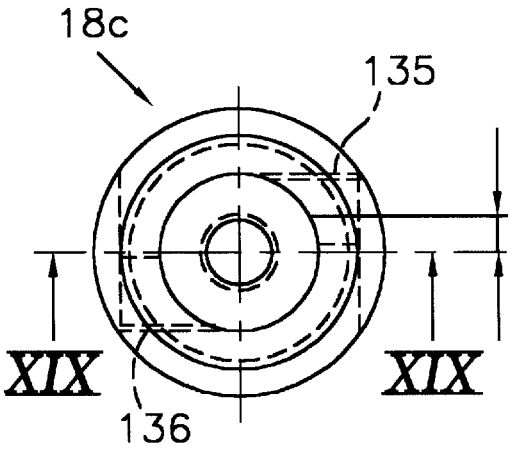
FIG. 20 represents a view of a nozzle in transverse section.

FIGS. 19 and 20 represent a sectional view of the nozzle carrier. The nozzle carrier has an axial nozzle (25) which screws into a thread (134) and two lateral nozzles which are screwed into threads (135, 136).

Figure 21:
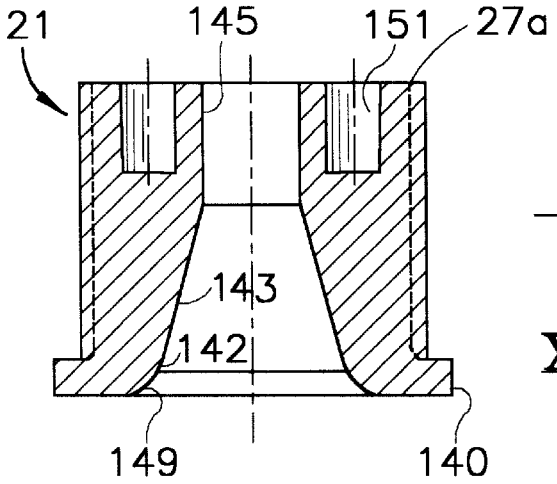
FIG. 21 represents a view of the nozzle in longitudinal section, taken along line XXI—XXI of FIG. 22.
Figure 22:
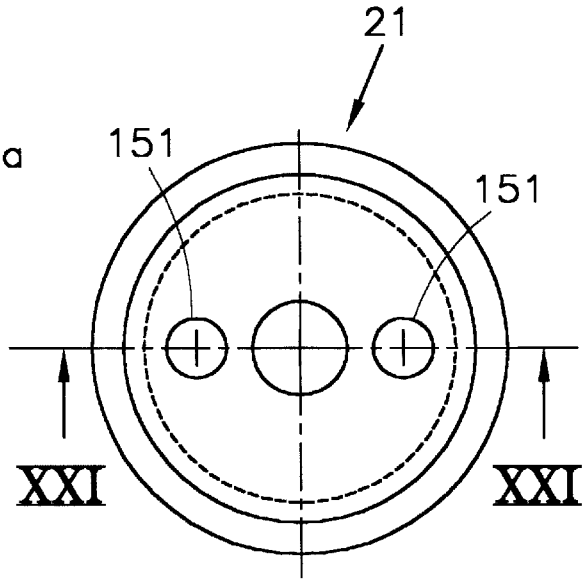
FIG. 22 represents a view of the nozzle in transverse section.

FIGS. 21 and 22 represent sectional views of nozzle carriers. The shoulder (140) acts as a final stop for the screw and prevents the front face of the nozzle from projecting out from the external surface of the nozzle carrier. The rounding at the junction (141) between the conical part (142) and the shoulder (140) has a radius of about 2 mm. The rounding at the junction (143) between the conical part (142) and the cylindrical part (145) has a radius of about 10 mm. The total length of the nozzle is about 18 mm and the internal diameter is about 5 mm. With two recesses or blind holes (150, 151) in the front face and with the appropriate wrench, the screwing may be ended within the wall of the nozzle carrier.

What is claimed is:

1. A hydrodynamic stirring device which dissolves, mixes or puts back into suspension or into a "sol" in a primary liquid phase, a deposited sediment which is contained in a tank and covered by said primary liquid phase comprising:

suction means including at least one pump to remove liquid from said primary liquid phase in said tank; and injection means connected to a discharge side of the suction means and equipped for reinjecting said liquid into said tank, towards said deposited sediment, in the form of at least one jet having a predefined pressure and flow rate, said injection means comprising at least one tube which bears at an end portion thereof, a self-rotating lance, said lance including a hollow cylindrical stator having open end portions and which is connected through a first of said end portions to said tube and wherein a nozzle bearing rotor is rotatably mounted at a second of said end portions of said stator, and said rotor bearing, at its periphery, at least two nozzles, each having a radial direction component, at least one of said nozzles having an orifice directed to have a tangential direction component with respect to the nozzle bearing rotor, wherein the nozzles are arranged such that force directed along the radial components is canceled out; and wherein said stator and said rotor define a chamber therebetween, said chamber being in fluid communication with said primary liquid phase via at least one annular slit defined by said rotor.

2. The device according to claim 1, wherein the nozzles are arranged in such angular directions and with such orientations that the axes of their respective orifices are deduced from one another by rotation through an angle of 360°/n about a central axis of the nozzle bearing rotor, wherein n is the number of nozzles located on a periphery of the nozzle bearing rotor.

3. The device according to claim 1, wherein each of the nozzles located at a periphery of the nozzle bearing rotor has an orifice, an axis of which forms an angle of about 30° with respect to a radius corresponding to the angular position in which the nozzle under consideration is to be found.

4. The device according to claim 1, wherein axes of the orifices of the nozzles are offset laterally with respect to radial longitudinal planes.

5. The device according to claim 4, wherein said nozzle bearing rotor further comprises two nozzle carriers, axes of the orifices of the nozzles of which are substantially parallel and laterally offset on either side of a median plane formed by a diametric axis and a longitudinal axis.

6. The device according to claim 5, wherein the nozzle carriers have at least one nozzle opening onto a front face of the nozzle carrier directed towards the bottom of the tank.

7. The device according to claim 4, wherein a lateral offset between an orifice of the nozzle carrier and the plane formed by a radial axis and the longitudinal axis is about 8 to 14 mm.

8. The device according to claim 1, wherein axes of the orifices of the nozzles located at a periphery of the nozzle bearing rotor are arranged in a plane substantially perpendicular to a central axis of rotation of the nozzle bearing rotor.

9. The device according to claim 1, wherein axes of the orifices of the nozzles located on a periphery of the nozzle bearing rotor are inclined in the direction of a central axis of rotation of the nozzle bearing rotor.

10. The device according to claim 1, wherein axes of the orifices of the nozzles located on a periphery of the nozzle bearing rotor form an angle of about 75° with respect to a central axis of rotation of the nozzle bearing rotor.

11. The device according to claim 1, wherein the nozzle bearing rotor surrounds the hollow cylindrical stator over a part of its length, and wherein the chamber formed between said rotor and said stator has closed off end portions, and, in said chamber, a thrust bearing and at least one radial bearing are provided for mounting the rotor rotatably with respect to the stator.

12. The device according to claim 1, further comprising a plurality of lances whose heights may be adjusted in an independent manner.

13. A hydrodynamic stirring device which dissolves, mixes or puts back into suspension or into a "sol" in a primary liquid phase, a deposited sediment which is contained in a tank and covered by said primary liquid phase comprising:

suction means including at least one pump to remove liquid from said primary liquid phase in said tank; and injection means connected to a discharge side of the suction means and equipped for reinjecting said liquid into said tank, towards said deposited sediment, in the form of at least one jet having a predefined pressure and flow rate, said injection means comprising at least one tube which bears at an end portion thereof, a self-rotating lance, said lance including a hollow cylindrical stator having open end portions and which is connected through a first of said end portions to said tube and wherein a nozzle bearing rotor is rotatably mounted at a second of said end portions of said stator and said rotor bearing, at its periphery, at least two nozzles or jets, each having a radial component of direction at least one of said nozzles or jets having an orifice directed to have a tangential direction component with respect to the nozzle bearing rotor, wherein the nozzles are arranged such that force directed along the radial components is canceled out; and wherein the orifice of each nozzle comprises, from inside towards the outside of the nozzle bearing rotor, a first conical part that tapers in the direction of flow of the liquid and a second cylindrical part.

14. The device according to claim 13, wherein the first conical part has an axial length which is about half that of the second cylindrical part.

15. The device according to claim 13, wherein the first conical part has a cone apical angle of about 30°, and the second cylindrical part has a diameter d of about 5 mm.

16. A hydrodynamic stirring device which dissolves, mixes or puts back into suspension or into a "sol" in a primary liquid phase, a deposited sediment which is contained in a tank and covered by said primary liquid phase comprising:

suction means including at least one pump to remove liquid from said primary liquid phase in said tank; and injection means connected to a discharge side of the suction means and equipped for reinjecting said liquid into said tank, towards said deposited sediment, in the form of at least one jet having a predefined pressure and flow rate, said injection means comprising at least one tube which bears at an end portion thereof, a self-rotating lance, said lance including a hollow cylindrical stator having two open end portions and which is connected through a first of said two end portions to said tube and wherein a nozzle bearing rotor is rotatably mounted on said stator, and said rotor bearing, at its periphery, at least two nozzles or jets, each having a radial component of direction at least one of said nozzles or jets having an orifice directed to have a tangential direction component with respect to the nozzle bearing rotor, wherein the nozzles are arranged such that force directed along the radial components is canceled out;

wherein the nozzle bearing rotor surrounds the hollow cylindrical stator over a part of its length, and wherein an elongate annular chamber is formed between said rotor and said stator, wherein said chamber is closed off at both of its end portions, and, in said elongate annular chamber, a thrust bearing and at least one radial bearing are provided for mounting the rotor rotatably with respect to the stator; and further comprising two axial rolling bearings and two radial rolling bearings, which provide rotation and guidance of the rotor assembly, the volume between the rotor and the stator forming a chamber hermetically closed by two rotary joints and a lubrication chamber.

17. The device according to claim 16, further comprising three nozzles which have an orifice with a diameter of about 5 mm.

18. A hydrodynamic stirring device which dissolves, mixes or puts back into suspension or into a "sol" in a primary liquid phase, a deposited sediment which is contained in a tank and covered by said primary liquid phase comprising:

suction means including at least one pump to remove liquid from said primary liquid phase in said tank; and injection means connected to a discharge side of the suction means and equipped for reinjecting said liquid into said tank, towards said deposited sediment, in the form of at least one jet having a predefined pressure and flow rate, said injection means comprising at least one tube which bears at an end portion thereof, a self-rotating lance, said lance including a hollow cylindrical stator having open end portions and which is connected through a first of said end portions to said tube and wherein a nozzle bearing rotor is rotatably mounted on said stator at a second of said end portions, and said rotor bearing, at its periphery, at least two nozzles or jets, each having a radial component of direction at least one of said nozzles or jets having an orifice directed to have a tangential direction component with respect to the nozzle bearing rotor, wherein the nozzles are arranged such that force directed along the radial components is canceled out;

wherein the nozzle bearing rotor surrounds the hollow cylindrical stator over a part of its length, and wherein an elongate annular chamber is formed between said rotor and said stator, wherein said chamber is closed off at both of its end portions, and, in said elongate annular chamber, a thrust bearing and at least one radial bearing are provided for mounting the rotor rotatably with respect to the stator; and wherein the nozzle bearing rotor comprises three parts arranged successively in an axial direction, including a first end part which extends the hollow cylindrical stator to a second end, has a cavity that communicates with an internal channel of said hollow cylindrical stator and bears said nozzles, an intermediate tubular cylindrical part which surrounds the cylindrical stator and which has a greater internal diameter than the external diameter of said cylindrical stator, and defines said elongate annular chamber, and a second end part which surrounds said cylindrical stator with a small radial clearance and which closes off said elongate annular chamber on a side of the first end portion of said hollow cylindrical stator.

19. The device according to claim 18, wherein said hollow cylindrical stator has on its external surface, inside said elongate annular chamber two cylindrical parts, axially spaced apart, which have a greater external diameter than a remaining part of said stator and which form two plain bearings for the nozzle bearing rotor and said thrust bearing is arranged between the second end part of the nozzle bearing rotor and one of the two cylindrical parts of greater external diameter of said stator.

20. The device according to claim 18, wherein at least the second end part and the intermediate part of the nozzle bearing rotor are in the form of separate elements fitted with complementary, threaded cylindrical parts to enable them to be assembled.

21. A lance for use in a hydrodynamic stirring device, wherein said lance comprises:

at least one tube which bears at an end portion thereof, a self-rotating lance, said lance including a hollow cylindrical stator having open end portions and which is connected through a first of said end portions to said tube and wherein a nozzle bearing rotor is rotatably mounted at a second of said end portions of said stator, and said rotor bearing, at its periphery, at least two nozzles, each having a radial direction component, at least one of said nozzles having an orifice directed to have a tangential direction component with respect to the nozzle bearing rotor, wherein the nozzles are arranged such that force directed along the radial components is canceled out; and wherein said stator and said rotor define a chamber therebetween, said chamber being in fluid communication with a primary liquid phase via at least one annular slit defined by said rotor.

* * * * *